US010113237B2

(12) United States Patent
Hoshikawa et al.

(10) Patent No.: US 10,113,237 B2
(45) Date of Patent: Oct. 30, 2018

(54) MANUFACTURING METHOD OF ROTATING MACHINE, PLATING METHOD OF ROTATING MACHINE, AND ROTATING MACHINE

(71) Applicant: MITSUBISHI HEAVY INDUSTRIES, LTD., Tokyo (JP)

(72) Inventors: Takanobu Hoshikawa, Tokyo (JP); Yusuke Ishibashi, Tokyo (JP); Yujiro Watanabe, Tokyo (JP); Yuya Konno, Tokyo (JP); Kosei Kawahara, Tokyo (JP); Yohei Fuchigami, Tokyo (JP); Toshio Nishina, Saitama (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 142 days.

(21) Appl. No.: 14/417,750

(22) PCT Filed: Dec. 26, 2013

(86) PCT No.: PCT/JP2013/084810
§ 371 (c)(1),
(2) Date: Jan. 27, 2015

(87) PCT Pub. No.: WO2014/104166
PCT Pub. Date: Jul. 3, 2014

(65) Prior Publication Data

US 2015/0299862 A1 Oct. 22, 2015

(30) Foreign Application Priority Data

Dec. 28, 2012 (JP) ..... 2012-288535

(51) Int. Cl.
*C23C 18/16* (2006.01)
*F04D 29/02* (2006.01)
(Continued)

(52) U.S. Cl.
CPC ..... *C23C 18/1619* (2013.01); *C23C 18/1616* (2013.01); *C23C 18/1628* (2013.01);
(Continued)

(58) Field of Classification Search
CPC ..... C23C 18/1619; C23C 18/1827; C23C 18/1616; C23C 18/1628; C23C 18/1646;
(Continued)

(56) References Cited

U.S. PATENT DOCUMENTS 3,709,715 A * 1/1973 Edmunds et al. .. C23C 18/1616 427/235
5,545,433 A 8/1996 Aanestad
(Continued)

FOREIGN PATENT DOCUMENTS

CN 1065907 A 11/1992
CN 101628282 A 1/2010
(Continued)

OTHER PUBLICATIONS

Extended European Search Report, dated Jul. 7, 2016, for European Application No. 13868496.4.
(Continued)

*Primary Examiner* — Jacob Cigna
*Assistant Examiner* — Lee A Holly
(74) *Attorney, Agent, or Firm* — Birch, Stewart, Kolasch & Birch, LLP

(57) ABSTRACT

A manufacturing method of a rotating machine (100) includes: a casing forming process (S0) of forming a casing (1) of the rotating machine (100) having openings (5, 6, 10, 11) and suctioning and discharging a fluid (F); a surface activating process (S2) of supplying and discharging a pretreatment liquid (W1) into and from the casing (1) through the openings (5, 6, 10, 11) and activating an inner surface (1*a*) of the casing (1); a preheating process (S4) of
(Continued)

supplying and discharging a preheating liquid (W2) into and from the casing (1) through the openings (5, 6, 10, 11) and preheating the casing (1); a plating process (S5) of supplying and discharging a plating liquid (W3) into and from the casing (1) through the openings (5, 6, 10, 11), and circulating the plating liquid to plate the inner surface (1*a*) of the casing (1); and an assembling process (S7) of providing a rotating body (3, 4) such that the rotating body is covered from an outer peripheral side by the plated casing (1). In the surface activating process (S2), the preheating process (S4), and the plating process (S5), when the liquid level of each of the liquids used in each process is vertically changed in the casing (1), each of the liquids is supplied to the inner surface (1*a*) of the casing (1) in a range above the liquid level by a treatment liquid auxiliary supply device (18).

4 Claims, 5 Drawing Sheets

(51) Int. Cl.

| | |
|---|---|
| ***F04D 29/40*** | (2006.01) |
| ***F04D 29/42*** | (2006.01) |
| ***F04D 29/52*** | (2006.01) |
| ***C23C 18/18*** | (2006.01) |
| *C23C 18/32* | (2006.01) |

(52) U.S. Cl.
CPC ..... *C23C 18/1646* (2013.01); *C23C 18/1827* (2013.01); *F04D 29/023* (2013.01); *F04D 29/026* (2013.01); *F04D 29/403* (2013.01); *F04D 29/406* (2013.01); *F04D 29/4206* (2013.01); *F04D 29/426* (2013.01); *F04D 29/522* (2013.01); *F04D 29/528* (2013.01); *C23C 18/32* (2013.01); *F05D 2230/21* (2013.01); *F05D 2230/31* (2013.01)

(58) Field of Classification Search
CPC ... C23C 18/32; F04D 29/4206; F04D 29/403; F04D 29/406; F04D 29/426; F04D 29/026; F04D 29/522; F04D 29/528; F04D 29/023
See application file for complete search history.

(56) References Cited

U.S. PATENT DOCUMENTS

| | | | |
|---|---|---|---|
| 2009/0324405 | A1 | 12/2009 | Yasui et al. |
| 2012/0207592 | A1 | 8/2012 | Tsutsui |

FOREIGN PATENT DOCUMENTS

| | | | | |
|---|---|---|---|---|
| DE | 19816325 | A1 | 10/1999 | |
| JP | 2-50986 | B2 | 11/1990 | |
| JP | 6-33891 | A | 2/1994 | |
| JP | 8-178585 | A | 7/1996 | |
| JP | 8-319576 | A | 12/1996 | |
| JP | 2000-34991 | A | 2/2000 | |
| JP | 2007-197766 | A | 8/2007 | |
| JP | 2008-127598 | A | 6/2008 | |
| JP | 2009-112946 | A | 5/2009 | |
| JP | 2014-129575 | A | 7/2014 | |
| WO | WO 2006/126993 | A1 | 11/2006 | |
| WO | WO 2006126993 | A1 * | 11/2006 | ..... F01D 5/286 |

OTHER PUBLICATIONS

Japanese Office Action dated Dec. 1, 2015 in corresponding Japanese Application No. 2012-288535 with an English Translation.
International Search Report issued PCT/JP2013/084810, dated Jan. 28, 2014.
PCT/ISA/237—Issued in PCT/JP2013/084810, mailed on Jan. 28, 2014.
Office Action dated Feb. 14, 2016 in counterpart Chinese Application No. 201380039421.9 with an English Translation.

* cited by examiner

MANUFACTURING METHOD OF ROTATING MACHINE, PLATING METHOD OF ROTATING MACHINE, AND ROTATING MACHINE

TECHNICAL FIELD

The present invention relates to plating work performed on an inner surface of a casing when a rotating machine is manufactured.

Priority is claimed on Japanese Patent Application No. 2012-288535, filed on Dec. 28, 2012, the contents of which are incorporated herein by reference.

BACKGROUND ART

For example, a rotating machine such as a centrifugal compressor or a turbine is provided with a casing that covers rotating body such as a rotary shaft and a blade set from an outer circumference side. Since an interior of the casing is exposed to a working fluid, plating is carried out on an inner surface of the casing as a measure for anticorrosion, for instance, when the working fluid is carbon dioxide.

Here, such plating work is typically done by immersing the casing in a plating liquid in a plating tank. Accordingly, a plating tank that has a large volume and is appropriate for the dimensions of the casing of the rotating machine is currently required, which inevitably leads to higher costs.

Incidentally, a plating method of sending a plating liquid into an interior of a long pipe under pressure and plating an inner surface of the long pipe without using a plating tank is disclosed in Patent Literature 1.

CITATION LIST

Patent Literature

[Patent Literature 1]

Japanese Unexamined Patent Application, First Publication No. H08-319576

SUMMARY OF INVENTION

Technical Problem

However, if the plating method of Patent Literature 1 is used, no plating tank is required, which leads to a reduction of costs, but the dimensions of the casing are very large. For this reason, when the method of Patent Literature 1 is adapted to be applied to the plating work for the inner surface of the casing of the rotating machine, if each liquid provided for the plating work is supplied and discharged to and from the inner surface of the casing, the amounts of time these liquids spend in contact with the inner surface of the casing are not uniform on the entire inner surface of the casing. For example, if the liquid is intended to be discharged from below, the contact time of the liquid on the lower inner surface of the casing is prolonged. Therefore, a quality of plating may be reduced.

An object of the present invention is to provide a manufacturing method of a rotating machine, a plating method of the rotating machine, and the rotating machine, all of which can secure a quality of plating while reducing costs.

Solution to Problem

A manufacturing method of a rotating machine according to a first aspect of the present invention includes: a casing forming process of forming a casing of the rotating machine that has multiple openings and suctions and discharges a fluid; a surface activating process of supplying a pretreatment liquid into the casing through the openings, then discharging the pretreatment liquid from the casing through the openings, and activating an inner surface of the casing after the casing forming process; a preheating process of supplying a preheating liquid into the casing through the openings, then discharging the preheating liquid from the casing through the openings, and preheating the casing after the surface activating process; a plating process of performing supply and discharge of a plating liquid into and from the casing through the openings to circulate the plating liquid and plating the inner surface of the casing after the preheating process; and an assembling process of providing a rotating body that is rotatable relative to the casing such that the rotating body is covered from an outer circumference side by the casing plated in the plating process, wherein, when a liquid level of each of the pretreatment liquid, the preheating liquid, and the plating liquid in the surface activating process, the preheating process, and the plating process is vertically changed in the casing, each of the pretreatment liquid, the preheating liquid, and the plating liquid corresponding to each process is supplied to the inner surface of the casing in a range above the liquid levels by a treatment liquid auxiliary supply device.

According to this manufacturing method of the rotating machine, the inner surface of the casing is activated by the pretreatment liquid from the openings formed in the casing, and the casing is preheated by the preheating liquid from the openings formed in the casing. Further, plating work is performed by the circulation of the plating liquid. In this case, each liquid is stored in the casing from a lower side of the casing when supplied, and is reduced from an upper side of the casing when discharged. Accordingly, a time during which an upper inner surface of the casing is in contact with these liquids is reduced, whereas a time during which a lower inner surface of the casing is in contact with these liquids is increased. Here, depending on the vertical change in the liquid level of the liquid in each process, the treatment liquid auxiliary supply device supplies each liquid to the inner surface of the casing which is located above the liquid level. Thereby, the contact time of each liquid can be made uniform on the entire inner surface of the casing. Therefore, a preheating tank and a plating tank for immersing the entire casing are not required, and thus the uniform plating work is possible.

In a manufacturing method of a rotating machine according to a second aspect of the present invention, in the surface activating process, the preheating process, and the plating process in the first aspect, the pretreatment liquid, the preheating liquid, and the plating liquid corresponding to each process may be sprayed onto the inner surface of the casing by the treatment liquid auxiliary supply device.

In this way, each liquid is sprayed and supplied onto the inner surface of the casing above the liquid level by the treatment liquid auxiliary supply device. Thereby, each liquid can be more efficiently brought into contact with the inner surface of the casing. Further, each liquid is sprayed. Thereby, each liquid can be supplied even onto a portion having a unique shape such as an opening. Therefore, the uniform plating work is made possible, and the quality of plating can be improved.

Further, in a manufacturing method of a rotating machine according to a third aspect of the present invention, in the surface activating process, the preheating process, and the plating process in the second aspect, the pretreatment liquid, the preheating liquid, and the plating liquid may be sprayed onto the inner surface of the casing while the treatment liquid auxiliary supply device is moved.

Thereby, the treatment liquid auxiliary supply device can be moved depending on the change in the liquid level. For this reason, each liquid can be more reliably brought into contact with the inner surface of the casing. Therefore, the quality of plating can be further improved.

Further, a rotating machine according to a fourth aspect of the present invention is manufactured by the manufacturing method according to any one of the first to third aspects.

According to this rotating machine, depending on the vertical change in the liquid level of the liquid in each of the surface activating process, the preheating process, and the plating process, the treatment liquid auxiliary supply device supplies each liquid to the inner surface of the casing above the liquid level. Accordingly, the contact time of each liquid can be made uniform on the entire inner surface of the casing. Therefore, the preheating tank and the plating tank for immersing the entire casing are not required, and thus the uniform plating work is possible.

Further, a plating method of a rotating machine according to a fifth aspect of the present invention is a method of plating an inner surface of a casing of the rotating machine that has an opening and suctioning and discharging a fluid to an interior and exterior thereof, and includes: a surface activating process of supplying a pretreatment liquid into the casing through the opening, filling the casing with the pretreatment liquid, then discharging the pretreatment liquid from the casing through the opening, and activating the inner surface of the casing; a preheating process of supplying a preheating liquid into the casing through the opening, filling the casing with the preheating liquid, then discharging the preheating liquid from the casing through the opening, and preheating the casing after the surface activating process; and a plating process of performing supply and discharge of a plating liquid into and from the casing through the openings to circulate the plating liquid and plating the inner surface of the casing after the preheating process.

According to this plating method of the rotating machine, depending on a vertical change in the liquid level of the liquid in each process, the treatment liquid auxiliary supply device supplies each liquid to the inner surface of the casing above the liquid level. Accordingly, a contact time of each liquid can be made uniform on the entire inner surface of the casing. Therefore, a preheating tank and a plating tank for immersing the entire casing are not required, and thus uniform plating work is possible.

Further, a rotating machine according to a sixth aspect of the present invention is manufactured by the plating method according to the fifth aspect.

According to this rotating machine, a contact time of each liquid can be made uniform on the entire inner surface of the casing by the plating method. Therefore, a preheating tank and a plating tank for immersing the entire casing are not required, and thus the rotating machine can be manufactured by performing uniform plating work.

Advantageous Effects of Invention

According to the manufacturing method of the rotating machine, the plating method of the rotating machine, and the rotating machine, it is possible to perform uniform plating work while reducing costs and to secure a quality of plating, using the pretreatment liquid auxiliary supply device.

DESCRIPTION OF EMBODIMENTS

First Embodiment

Hereinafter, a manufacturing method of a centrifugal compressor (rotating machine) 100 according to a first embodiment of the present invention will be described.

The centrifugal compressor 100 manufactured by the present embodiment is a device that takes in a fluid F, circulates the fluid F along an axis O, and thereby raises a pressure of the fluid F.

Figure 1:
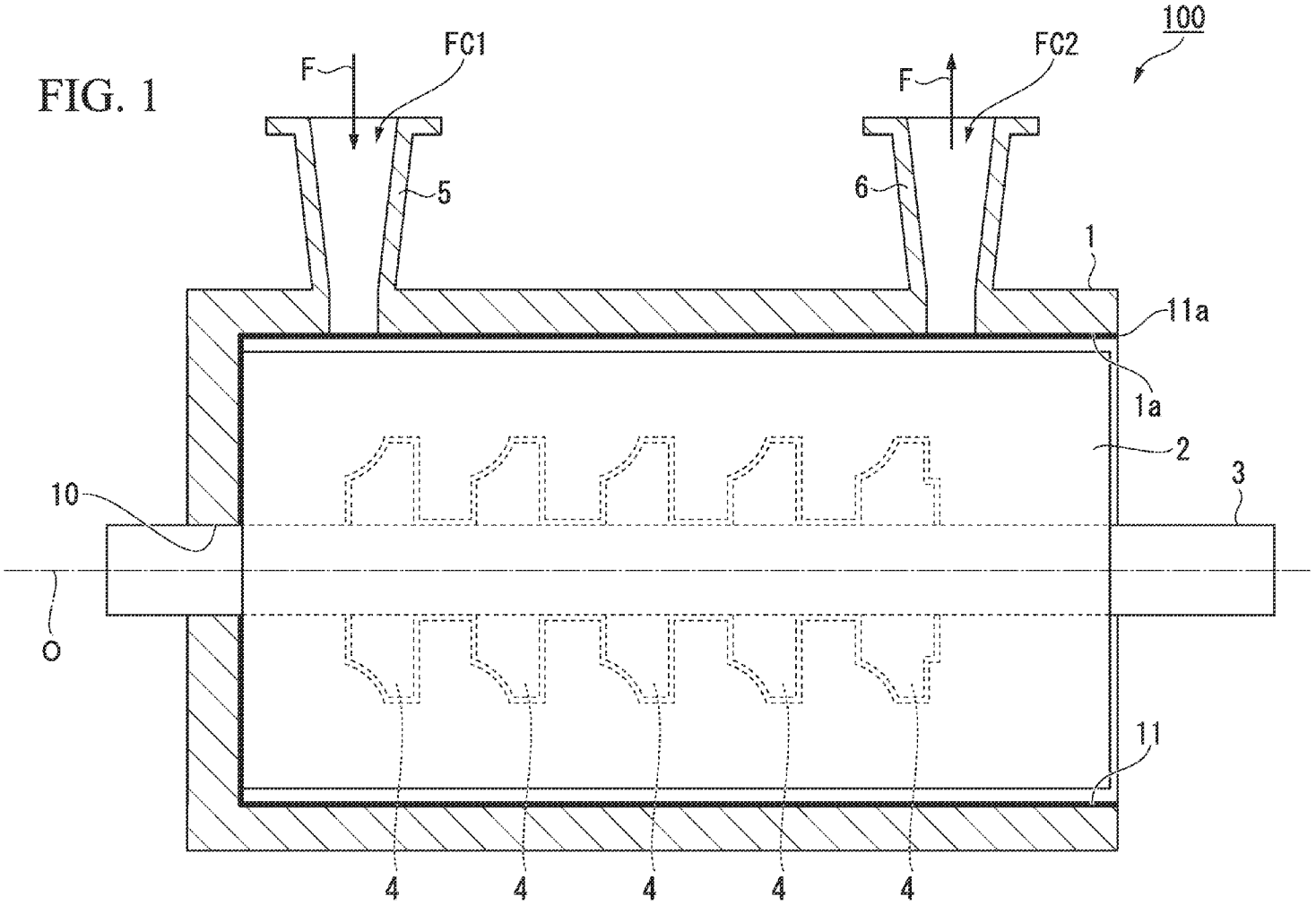
FIG. 1 is a schematic cross-sectional view illustrating a centrifugal compressor manufactured by a manufacturing method of the centrifugal compressor according to a first embodiment of the present invention.

As illustrated in FIG. 1, the centrifugal compressor 100 includes a casing 1 having a cylindrical shape, an internal casing 2 that is adapted to be covered from an outer circumference side thereof by the casing 1 and is provided so as not to be relatively rotatable with respect to the casing 1, and a rotary shaft (rotating body) 3 and an impeller (rotating body) 4 that are covered from an outer circumference side thereof by the internal casing 2 and are provided to be relatively rotatable with respect to the internal casing 2.

The rotary shaft 3 has a columnar shape whose center is an axis O, and extends in a direction of the axis O. The impeller 4 has multiple stages that are fitted onto the rotary shaft 3 at predetermined intervals in the direction of the axis O and are rotated about the axis O along with the rotary shaft 3.

The internal casing 2 supports the rotary shaft 3 and the impeller 4. Further, a channel (not shown) is formed between the stages of the impeller 4 in the internal casing 2, and the fluid F is gradually circulated from the foremost stage to the rearmost stage of the impeller 4 via the channel and is increased in pressure.

The casing 1 has a cylindrical shape whose center is the axis O and in which an upstream opening 10 of one side of the axis O (left side in the space of FIG. 1) and a downstream opening 11 of the other side of the axis O are formed, and takes an external form of the centrifugal compressor 100. In the present embodiment, the casing 1 is shaped to protrude toward a radial inner side of the axis O in an annular shape at an end of one side of the axis O. Thereby, in comparison with the downstream opening 11, the upstream opening 10 is adapted to have a smaller diameter.

The casing 1 has an intake port (opening) 5 of the fluid F which is provided at the end of one side serving as an upstream side in the direction of the axis O, and a discharge port (opening) 6 of the fluid F which is provided at the end of the other side to protrude from an outer circumferential surface thereof toward a radial outer side of the axis O. In the present embodiment, the casing 1 is one cylindrical member without a division plane.

The intake port 5 is formed with an intake channel FC1 that passes through the casing 1 in a radial direction of the axis O so as to communicate with the interior and exterior of the casing 1. The intake channel FC1 is adapted to communicate with an interior of the foremost-stage impeller 4, to take in the fluid F from the outside, and to allow the fluid F to flow into this impeller 4.

The discharge port 6 is formed with a discharge channel FC2 that passes through the casing 1 in the radial direction of the axis O so as to communicate with the interior and exterior of the casing 1. The discharge channel FC2 is adapted to communicate with an interior of the rearmost-stage impeller 4 and to be able to discharge the fluid F from this impeller 4 to the outside.

Next, with regard to a manufacturing method (including a plating method) for the centrifugal compressor 100, first, an outline of manufacturing processes will be given, and then details of each process will be described.

Figure 2:
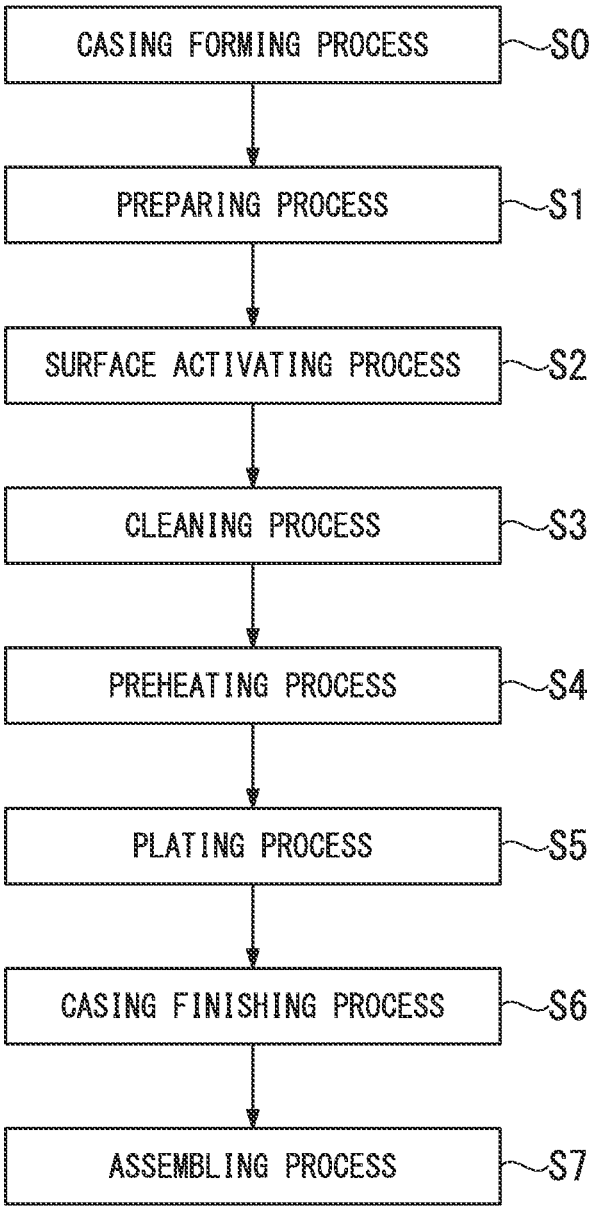
FIG. 2 is a flow chart illustrating a procedure of the manufacturing method of the centrifugal compressor according to the first embodiment of the present invention.

As illustrated in FIG. 2, the manufacturing method of the centrifugal compressor 100 includes a casing forming process S0 of forming the casing 1, a preparing process S1 of preparing plating work for the inner surface 1*a* of the casing 1 after the casing forming process S0, and a surface activating process S2 of supplying a pretreatment liquid W1 into the casing 1 after the preparing process S1 and activating the inner surface 1*a* of the casing 1.

Further, the manufacturing method of the centrifugal compressor 100 includes a cleaning process S3 of cleaning the interior of the casing 1 after the surface activating process S2, a preheating process S4 of supplying a preheating liquid W2 into the casing 1 and preheating the casing 1 after the cleaning process S3, a plating process S5 of supplying a plating liquid W3 into the casing 1 and plating the inner surface 1*a* of the casing 1 after the preheating process S4, and a casing finishing process S6 of finishing the casing 1 after the plating process S5.

Then, the manufacturing method of the centrifugal compressor 100 includes an assembling process S7 of incorporating the internal casing 2, the rotary shaft 3, and the impeller 4 into the casing 1 after the casing finishing process S6. The final centrifugal compressor 100 is manufactured via these processes.

First, the casing forming process S0 is carried out. In detail, a cylindrical casing 1 is formed using machining such as casting.

Next, the preparing process S1 is carried out. In detail, masking is performed on a portion of the casing 1 which need not be plated. Afterwards, the casing 1 is placed such that the direction of the axis O is identical to a vertical direction and the intake port 5 is disposed downward. Since the downstream opening 11 is placed upward at this point in time, among the intake port 5, the discharge port 6, the upstream opening 10, and the downstream opening 11 that are all the openings in the casing 1, the largest opening is directed upward.

Further, in the preparing process S1, a cover is put on the upstream opening 10 so as to prevent a liquid from leaking from the upstream opening 10. In addition, a pump 15 and a tank 16 (see FIG. 3) are installed to connect pipings 16*a* to the intake port 5 and the discharge port 6.

Although details of the tank 16 are not illustrated, three kinds of liquids, i.e. a pretreatment liquid W1, a preheating liquid W2, and a plating liquid W3, are adapted to each be stored separately. Then, the liquid used in each process is separately supplied into the casing 1 via the piping 16*a*. Further, the liquids discharged from the interior of the casing 1 are adapted to be recovered. Further, a pH value, a concentration, and a temperature of each liquid are properly adjusted to have predetermined values at all times.

In the preparing process S1, a degreasing liquid such as an alkaline solution is sprayed onto the inner surface 1*a* of the casing 1, and treatment such as degreasing is performed on the inner surface 1*a*. For example, as the degreasing liquid, a mixture such as sodium hydroxide, a silicate, and a surfactant is used. After the treatment of the inner surface 1*a* is performed, flushing is performed by spraying water onto the inner surface 1*a*.

Next, the surface activating process S2 is performed. In detail, the pretreatment liquid W1 is supplied from the tank 16 to the intake port 5 by the pump 15, and the interior of the casing 1 is filled with the pretreatment liquid W1. Afterwards, the pretreatment liquid W1 is discharged from the discharge port 6 of the casing 1, is recovered to the tank 16, and removes an oxide film of the inner surface 1*a* of the casing 1 to activate the inner surface 1*a*.

As the pretreatment liquid W1, for example, an acid solution such as a hydrochloric acid solution adjusted to room temperature is used.

Figure 3:
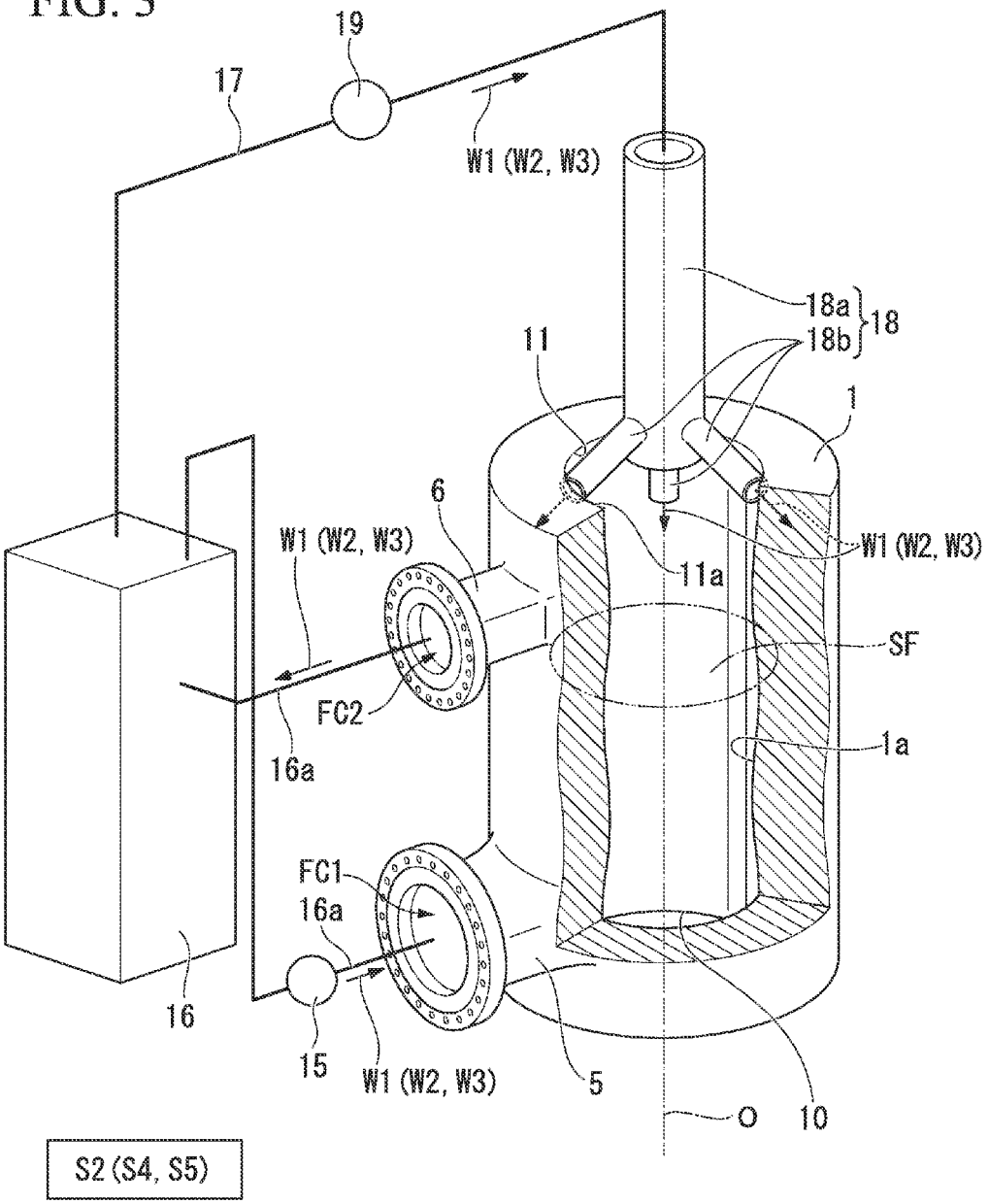
FIG. 3 is a perspective view illustrating an aspect of supplying each liquid using a nozzle member in the manufacturing method of the centrifugal compressor according to the first embodiment of the present invention.

Further, the surface activating process S2 as illustrated in FIG. 3 is carried out in a state in which a nozzle member 18 acting as a pretreatment liquid auxiliary supply device is inserted from the downstream opening 11.

Here, the nozzle member 18 has a tubular body 18*a* that extends in the direction of the axis O and is disposed outside the casing 1, and multiple branch pipes 18*b* that communicate with the body 18*a*, extend from a tip of the body 18*a* toward the inner surface 1*a* of the casing 1, and are provided at intervals in a circumferential direction of the axis O. Thus, the body 18*a* is connected to the tank 16 via piping 17 and a pump 19. The pretreatment liquid W1 is supplied from the branch pipes 18*b* toward the inner surface 1*a* of the casing 1 while the surface activating process S2 is carried out. The nozzle member 18 may not be inserted into the casing 1, and the branch pipes 18*b* may be at least open to the inner surface 1*a* of the casing 1.

The cleaning process S3 is carried out after the surface activating process S2. That is, flushing is performed on the inner surface 1*a* of the casing 1, which is activated by the pretreatment liquid W1, using a spray.

Next, the preheating process S4 is performed. In detail, with respect to the casing 1 flushed in the cleaning process S3, the preheating liquid W2 is supplied from the tank 16 to the intake port 5 by the pump 15, and the interior of the casing 1 is filled with the preheating liquid W2. Afterwards, the preheating liquid W2 is discharged from the discharge port 6 of the casing 1, is recovered to the tank 16, and raises a temperature of the casing 1 before the plating work.

As the preheating liquid W2, for example, an aqueous solution including a reductant adjusted to a temperature of about 90° C. is used. As the reductant, for example, sodium hypophosphite is used, but other typical reductants may be used.

Here, the flushing may be performed after the preheating process S4 has been performed.

Further, as illustrated in FIG. 3, similar to the surface activating process S2, the preheating process S4 is performed in a state in which the nozzle member 18 is inserted from the downstream opening 11, and the preheating liquid W2 is supplied from the branch pipes 18*b* toward the inner surface 1*a* of the casing 1 while the preheating process S4 is performed.

Next, the plating process S5 is performed. In detail, with respect to the casing 1 preheated in the preheating process S4, the plating liquid W3 is supplied from the tank 16 to the intake port 5 by the pump 15, and the interior of the casing 1 is filled with the plating liquid W3. In this state, the plating liquid W3 is discharged from the discharge port 6 and is recovered in the tank 16. In a state in which the interior of the casing 1 is filled with the plating liquid W3, the plating liquid W3 is circulated to plate the inner surface 1*a* of the casing 1.

As the plating liquid W3, for example, an electroless nickel plating liquid adjusted to a temperature of about 90° C. is used.

Further, as illustrated in FIG. 3, similar to the surface activating process S2 and the preheating process S4, the plating process S5 is performed in the state in which the nozzle member 18 is inserted from the downstream opening 11, and the plating liquid W3 is supplied from the branch pipes 18*b* toward the inner surface 1*a* of the casing 1 while the plating process S5 is performed.

Next, the casing finishing process S6 is performed. In detail, the plated inner surface 1*a* of the casing 1 is flushed using a spray first and then is dried, and the casing 1 is finished. Further, a baking treatment (hydrogen embrittlement removal) may be carried out.

Finally, the assembling process S7 is performed. In detail, the internal casing 2, the rotary shaft 3, and the impeller 4 are installed in the casing 1, and the centrifugal compressor 100 is manufactured.

In this manufacturing method of the centrifugal compressor 100, the pretreatment liquid W1 is supplied from the intake port 5 formed in the casing 1 and is discharged from the discharge port 6. Thereby, the inner surface 1*a* of the casing 1 is activated by the pretreatment liquid W1. Likewise, the preheating liquid W2 and the plating liquid W3 are supplied and discharged from the intake port 5 and the discharge port 6. Thereby, the plating work for the inner surface 1*a* of the casing 1 can be performed.

In detail, in the surface activating process S2, the preheating process S4, and the plating process S5, a preheating tank and a plating tank for immersing the entire casing 1 are not required. As such, the plating work can be performed on the inner surface 1*a* of the casing 1.

Incidentally, each of the pretreatment liquid W1, the preheating liquid W2, and the plating liquid W3 is stored in the casing 1 from a lower side of the casing 1 when supplied and is reduced from an upper side of the casing 1 when discharged. Therefore, the contact time of each liquid is reduced on the upper inner surface 1*a* of the casing 1, whereas the contact time of each liquid is increased on the lower inner surface 1*a* of the casing 1. This occurs especially significantly in a large casing 1.

Here, in the present embodiment, each liquid used in each of the surface activating process S2, the preheating process S4, and the plating process S5 can be separately supplied from the upper inner surface 1*a* of the casing 1 by the nozzle member 18. According to a vertical change in a liquid level SF of the inner surface 1*a* of the casing 1 when the liquid is supplied and discharged in each process, the nozzle member 18 can supply each liquid to the inner surface 1*a* of the casing 1 higher than the liquid level SF. For this reason, the contact time of each liquid can be made uniform on the entire inner surface 1*a* of the casing 1. Therefore, the preheating tank and the plating tank for immersing the entire casing 1 are not required, and thus uniform plating work is possible.

According to the manufacturing method of the centrifugal compressor 100 of the present embodiment, the pretreatment liquid W1, the preheating liquid W2, and the plating liquid W3 are supplied and discharged through the intake port 5 and the discharge port 6 that are formed in the casing 1, and thereby the costs can be reduced. Further, each liquid is supplied by the nozzle member 18, and thereby the quality of plating can be secured.

Here, in the present embodiment, the pretreatment liquid W1, the preheating liquid W2, and the plating liquid W3 are adapted to be supplied from the intake port 5 of the casing 1 and discharged from the discharge port 6. However, without being limited to such an example, conversely, each liquid may be supplied from the discharge port 6 and discharged from the intake port 5. Further, when there are multiple intake ports 5 and discharge ports 6 used for the supply and discharge, the multiple intake ports 5 and discharge ports 6 may be used for the supply and discharge of each liquid. Even in this case, only one opening may be used for the supply and discharge of the liquid. Furthermore, the upstream opening 10 and the downstream opening 11 may be used for the supply and discharge of the liquid. Further, in addition to the intake port 5, the discharge port 6, the upstream opening 10, and the downstream opening 11, each liquid may be supplied and discharged through other openings formed in the casing 1.

Further, of the intake port 5 and discharge port 6, the opening from which high corrosion resistance is particularly required may be subjected to overlaying using a stainless steel material. Such an opening requires no plating work. For this reason, as the pretreatment liquid W1, the preheating liquid W2, and the plating liquid W3 are supplied and discharged from the opening(s) from which the plating is required among the multiple openings, the inner surface 1*a* of the casing 1 can be plated, and these openings can be plated. Therefore, the casing 1 can be more efficiently plated.

For example, in a side stream type of compressor, two intake ports 5 and one discharge port 6 are provided. As such, the opening(s) for supplying and discharging the liquid can be appropriately selected from these intake port 5 and discharge port 6.

The reductant may not necessarily be contained in the preheating liquid W2 used in preheating process S4.

The supply of the plating liquid W3 may also be initiated before the preheating liquid W2 is completely discharged.

The casing 1 is placed in the state in which the downstream opening 11 is directed upward, and each liquid is supplied and discharged. However, the casing 1 may be placed, for instance, such that the direction of the axis O becomes a horizontal direction, i.e. such that a direction in which the upstream opening 10 and the downstream opening 11 are open becomes a horizontal direction, and each liquid may be supplied and discharged. In this case, the nozzle member 18 may be installed by insertion from any one of the upstream opening 10, the downstream opening 11, the intake port 5, and the discharge port. However, the nozzle member 18 needs to be installed such that the branch pipes 18*b* are open to an uppermost portion of the inner surface 1*a* of the casing 1.

Further, in the preparing process S1, the cleaning process S3, and the casing finishing process S6, the interior of the casing 1 is flushed by the spray. Instead of this, similar to the surface activating process S2, the preheating process S4, and the plating process S5, water may be supplied and discharged using the intake port 5, the discharge port 6, the upstream opening 10, and the downstream opening 11, and the inner surface 1*a* of the casing 1 may be flushed. The same is true even when the flushing is performed after the preheating process S4.

Second Embodiment

Next, a manufacturing method of a centrifugal compressor 100 according to a second embodiment of the present invention will be described.

The same components as in the first embodiment will be given the same numerals or symbols, and detailed description thereof will be omitted.

In the present embodiment, a nozzle member (a treatment liquid auxiliary supply device) 21 used in a surface activating process S2, a preheating process S4, and a plating process S5 is different from that of the first embodiment.

Figure 4:
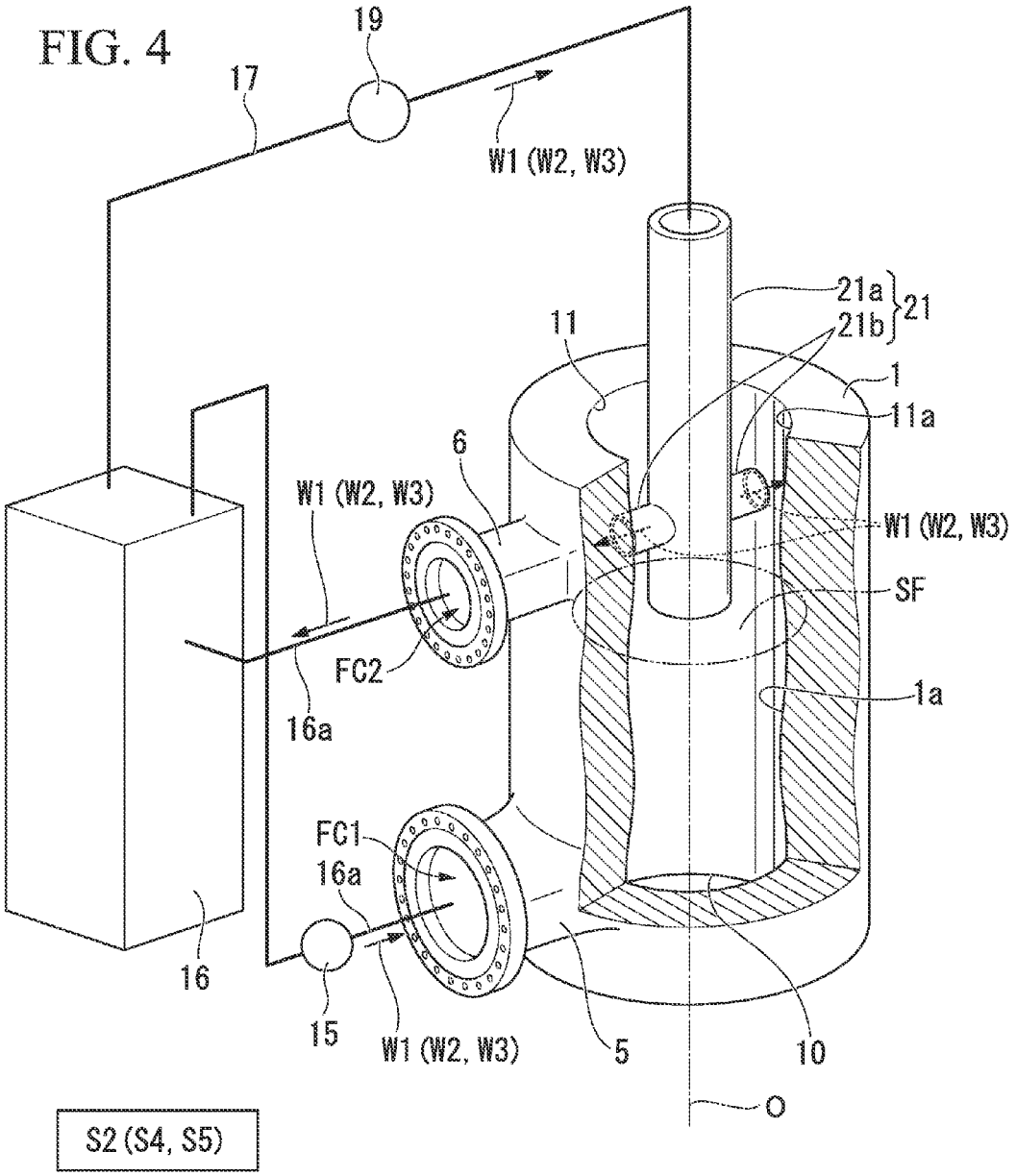
FIG. 4 is a perspective view illustrating an aspect of supplying each liquid using a nozzle member in a manufacturing method of a centrifugal compressor according to a second embodiment of the present invention.

As illustrated in FIG. 4, the nozzle member 21 has a tubular body 21*a* that extends in a direction of an axis O, and multiple branch pipes 21*b* that extend to a radial outer side of the axis O at a tip of the body 21*a* and are open to an inner surface 1*a* of a casing 1.

Thus, the nozzle member 21 is disposed at an upper portion higher than a liquid level SF of each of a pretreatment liquid W1, a preheating liquid W2, and a plating liquid W3. Further, the nozzle member 21 is inserted into the casing 1 such that openings of the branch pipes 21*b* are radially opposite to the inner surface 1*a* of the casing 1, and is a spray nozzle that injects and sprays the liquid corresponding to each process onto the inner surface 1*a* of the casing 1. Although details of the nozzle member 21 are not illustrated, a pressure is given to each liquid by for example, a pump, and thereby the liquid can be sprayed.

According to the manufacturing method of the centrifugal compressor 100 of the present embodiment, the spray nozzle is used as the nozzle member 21, and thereby each liquid can be sprayed and supplied onto an upper side of the inner surface 1*a* of the casing 1 which is higher than a liquid level SF. For this reason, depending on a vertical change in the liquid level SF in each process, the liquid can be more efficiently brought into contact with the inner surface 1*a* of the casing 1. Further, the liquid can be reliably sprayed and supplied even onto a portion having a unique shape such as interiors of intake and discharge channels FC1 and FC2. As such, a quality of plating can be improved.

For example, the nozzle member 21 may be manually operated such that it is disposed above the liquid level SF, preferably such that the openings of the branch pipes 21*b* are disposed opposite to an uppermost inner surface of the casing 1. Further, the liquid level SF may be detected by, for instance, a sensor, and the nozzle member 21 may be automatically moved by a controller.

Third Embodiment

Next, a manufacturing method of a centrifugal compressor 100 according to a third embodiment of the present invention will be described.

The same components as in the first and second embodiments will be given the same numerals or symbols, and detailed description thereof will be omitted.

In the present embodiment, a nozzle member (a treatment liquid auxiliary supply device) 31 used in a surface activating process S2, a preheating process S4, and a plating process S5 is different from those of the first and second embodiments.

Figure 5:
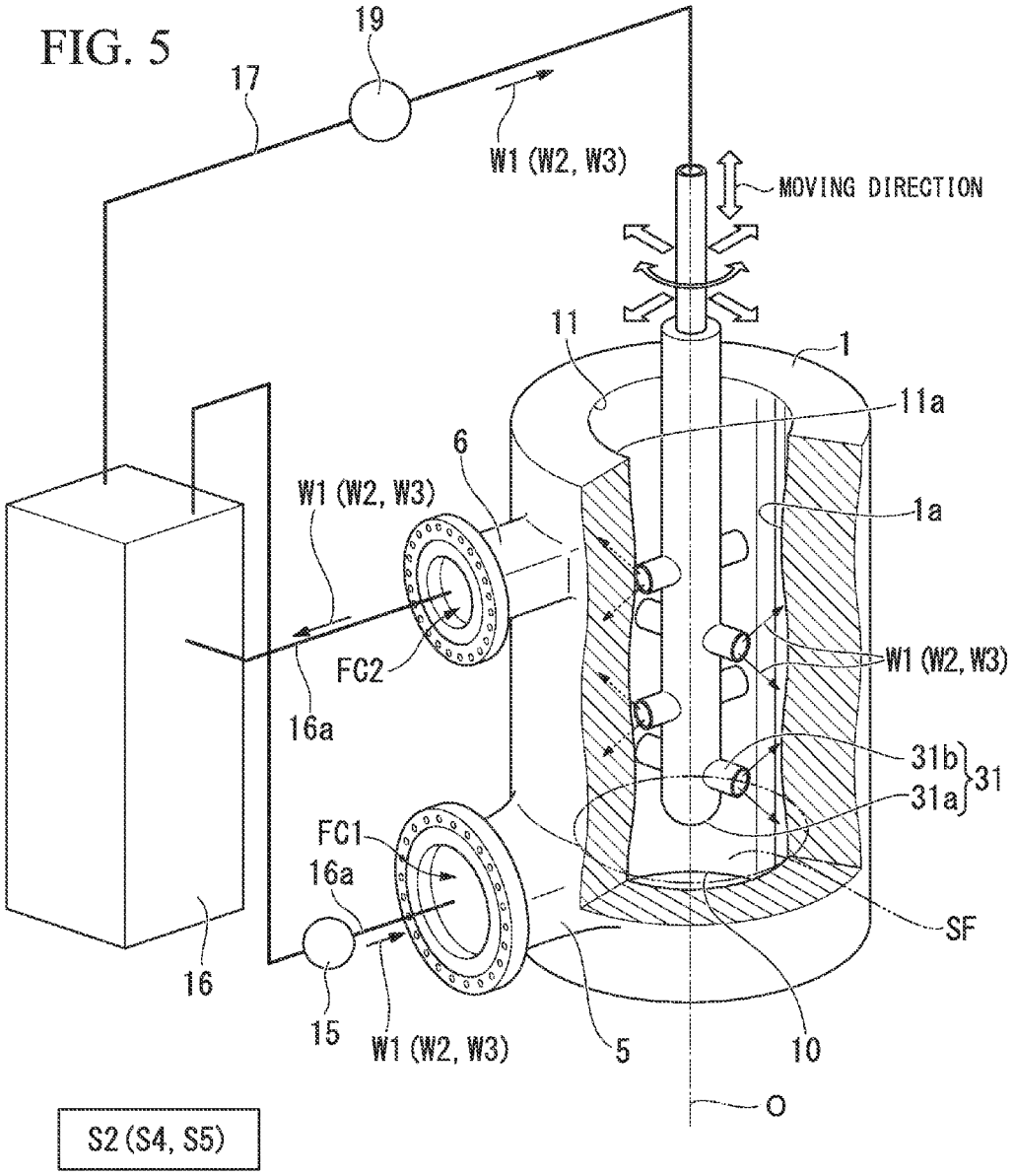
FIG. 5 is a perspective view illustrating an aspect of supplying each liquid using a nozzle member in a manufacturing method of a centrifugal compressor according to a third embodiment of the present invention.

As illustrated in FIG. 5, the nozzle member 31 has a tubular body 31*a* that extends in a direction of an axis O, and multiple branch pipes 31*b* that are provided on an outer circumferential surface of the body 31*a* at intervals in a circumferential direction and in the direction of the axis O, extend to a radial outer side of the axis O, and are open to an inner surface 1*a* of a casing 1.

The nozzle member 31 is disposed at an upper portion higher than a liquid level SF of each of a pretreatment liquid W1, a preheating liquid W2, and a plating liquid W3. Further, the nozzle member 31 is inserted into the casing 1 such that openings of the branch pipes 31*b* are radially opposite to the inner surface 1*a* of the casing 1, and is a spray nozzle that injects and sprays the liquid corresponding to each process onto the inner surface 1*a* of the casing 1. Although details of the nozzle member 31 are not illustrated, similar to the second embodiment, a pressure is given to each liquid by, for example, a pump, and thereby the liquid can be sprayed.

The nozzle member 31 can be subjected to vertical movement and rotation about the axis O by an electric motor (not shown).

According to the manufacturing method of the centrifugal compressor 100 of the present embodiment, each liquid can be sprayed and supplied in each process while the nozzle member 31 is vertically moved and rotated. That is, since an injection range and direction of the liquid can be variously selected, each liquid can be reliably brought into contact with the inner surface 1*a* of the casing 1. Therefore, a quality of plating can be further improved.

Although the preferred embodiments of the present invention have been described in detail, some design change is also possible without departing from the technical idea of the present invention.

In the aforementioned embodiments, the cylindrical type of casing 1 has been described with regard to the first to third embodiments. However, the manufacturing method of the centrifugal compressor 100 in these embodiments may be applied to a horizontal division type of casing 1. In this case, the casing 1 is preferably placed in a halved state with the division-side opening directed upward.

Further, in the aforementioned embodiments, the centrifugal compressor 100 has been described, but the aforementioned manufacturing method may be applied to other rotating machines such as an axial compressor, a turbine, and so on.

INDUSTRIAL APPLICABILITY

According to the manufacturing method of the rotating machine, the plating method of the rotating machine, and the rotating machine, all of which are described above, the treatment liquid auxiliary supply device is used. Thereby, the uniform plating work can be performed while the costs are reduced, and the quality of plating can be secured.

REFERENCE SIGNS LIST

1: casing
1*a*: inner surface
2: internal casing
3: rotary shaft (rotating body)
4: impeller (rotating body)
5: intake port (opening)
6: discharge port (opening)
10: upstream opening
11: downstream opening
11*a*: opening edge
15: pump

16: tank
16*a*: piping
17: piping
18: nozzle member (treatment liquid auxiliary supply device)
19: pump
18*a*: body
18*b*: branch pipe
100: centrifugal compressor
O: axis
FC1: intake channel
FC2: discharge channel
S0: casing forming process
S1: preparing process
S2: surface activating process
S3: cleaning process
S4: preheating process
S5: plating process
S6: casing finishing process
S7: assembling process
SF: liquid level
W1: pretreatment liquid
W2: preheating liquid
W3: plating liquid
21: nozzle member (treatment liquid auxiliary supply device)
21*a*: body
21*b*: branch pipe
31: nozzle member (treatment liquid auxiliary supply device)
31*a*: body
31*b*: branch pipe

The invention claimed is:

1. A manufacturing method of a rotating machine comprising:

a casing forming process of forming a casing of the rotating machine that has multiple openings and suctions and discharges a fluid;

a surface activating process of supplying a pretreatment liquid into the casing through the openings, then discharging the pretreatment liquid from the casing through the openings, and activating an inner surface of the casing after the casing forming process;

a preheating process of supplying a preheating liquid into the casing through the openings, then discharging the preheating liquid from the casing through the openings, and preheating the casing after the surface activating process;

a plating process of performing supply and discharge of a plating liquid into and from the casing through the openings to circulate the plating liquid and plating the inner surface of the casing after the preheating process; and an assembling process of providing a rotating body that is rotatable relative to the casing such that the rotating body is covered from an outer circumference side by the casing plated in the plating process, wherein, in the surface activating process, the preheating process, and the plating process, each of the pretreatment liquid, the preheating liquid, and the plating liquid corresponding to each process is supplied into the inner surface of the casing in a range above a liquid level of each of the pretreatment liquid, the preheating liquid, and the plating liquid corresponding to each process in the casing by a treatment liquid auxiliary supply device separately from each of the pretreatment liquid, the preheating liquid, and the plating liquid corresponding to each process which is supplied from the openings of the casing, and the treatment liquid auxiliary supply device is vertically moved according to a vertical change of the liquid level of each of the pretreatment liquid, the preheating liquid, and the plating liquid corresponding to each process in the casing.

2. The manufacturing method according to claim 1, wherein, in the surface activating process, the preheating process, and the plating process, each of the pretreatment liquid, the preheating liquid, and the plating liquid corresponding to each process is sprayed onto the inner surface of the casing by the treatment liquid auxiliary supply device.

3. The manufacturing method according to claim 2, wherein, in the surface activating process, the preheating process, and the plating process, the pretreatment liquid, the preheating liquid, and the plating liquid are sprayed onto the inner surface of the casing while the treatment liquid auxiliary supply device is moved.

4. A plating method of a rotating machine, which plates an inner surface of a casing of the rotating machine that has an opening and suctioning and discharging a fluid to an interior and exterior thereof, the plating method comprising:

a surface activating process of supplying a pretreatment liquid into the casing through the opening, filling the casing with the pretreatment liquid, then discharging the pretreatment liquid from the casing through the opening, and activating the inner surface of the casing;

a preheating process of supplying a preheating liquid into the casing through the opening, filling the casing with the preheating liquid, then discharging the preheating liquid from the casing through the opening, and preheating the casing after the surface activating process; and a plating process of performing supply and discharge of a plating liquid into and from the casing through the openings to circulate the plating liquid and plating the inner surface of the casing after the preheating process, wherein, in the surface activating process, the preheating process, and the plating process, each of the pretreatment liquid, the preheating liquid, and the plating liquid corresponding to each process is supplied into the inner surface of the casing in a range above a liquid level of each of the pretreatment liquid, the preheating liquid, and the plating liquid corresponding to each process in the casing by a treatment liquid auxiliary supply device separately from each of the pretreatment liquid, the preheating liquid and the plating liquid corresponding to each process which is supplied from the openings of the casing, and the treatment liquid auxiliary supply device is vertically moved according to a vertical change of the liquid level of each of the pretreatment liquid, the preheating liquid, and the plating liquid corresponding to each process in the casing.

* * * * *